United States Patent [19]

Eisermann et al.

[11] 4,433,772

[45] Feb. 28, 1984

[54] LOCK WITH LOCKING FUNCTION ADAPTED TO BE ACTUATED AFTER THE INSERTION OF A COIN

[75] Inventors: Armin Eisermann; Heinz T. Eicken; Diethard Geiger, all of Velbert, Fed. Rep. of Germany

[73] Assignee: Schulte-Schlagbaum AG, Velbert, Fed. Rep. of Germany

[21] Appl. No.: 380,503

[22] Filed: May 21, 1982

[30] Foreign Application Priority Data

Jun. 19, 1981 [DE] Fed. Rep. of Germany ..... 3124180

[51] Int. Cl.[3] ..... G07F 5/02

[52] U.S. Cl. ..... 194/59; 194/1 G

[58] Field of Search ..... 194/59, 65, 78, 51, 194/1 G, DIG. 2, 17, 74

[56] References Cited

U.S. PATENT DOCUMENTS 3,621,965 11/1971 Eicken ..... 194/59

4,333,556 6/1982 Robbins ..... 194/1 G X

FOREIGN PATENT DOCUMENTS 2017192 11/1978 Fed. Rep. of Germany .

*Primary Examiner*—Stanley H. Tollberg

*Attorney, Agent, or Firm*—Martin A. Farber

[57] ABSTRACT

A lock with a locking function adapted to be actuated after the insertion of a coin, in which the coin drops into a supported position in the bolt which is displaceable by key actuation, the edge of the coin releasing the bolt for the locking displacement by disengaging a pawl. The supported position is established by a resting point on the bolt side and a second resting point, the distance between the two resting points being variable as a function of the closing movement. One of the resting points is formed by the free, eccentrically shaped end of a rotary projection which is seated in a bolt-side lever which upon locking movement passes against spring action into a position which is at a greater distance from the bolt resting point. The rotary projection forms an attack surface, facing the rear wall of the lock, for a conversion tool.

14 Claims, 15 Drawing Figures

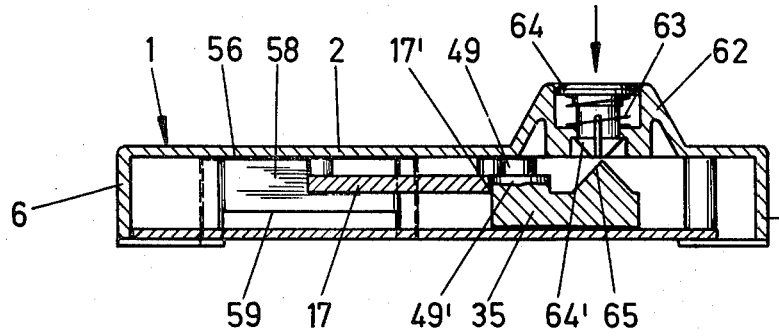
FIG. 7
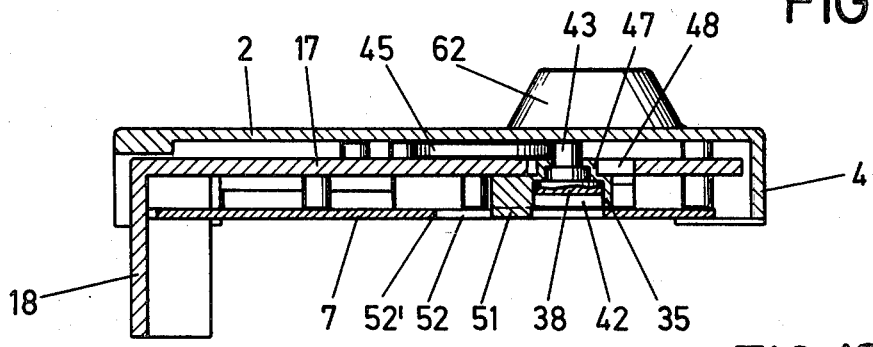
FIG. 8
FIG. 9
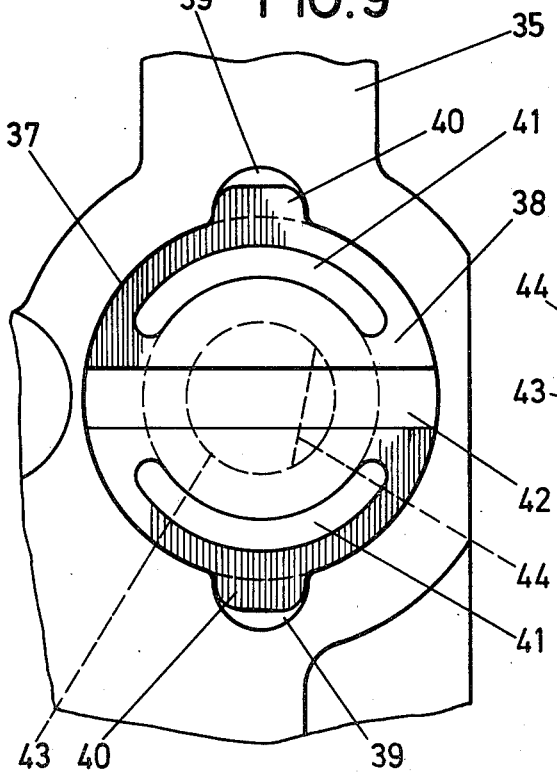
FIG. 10
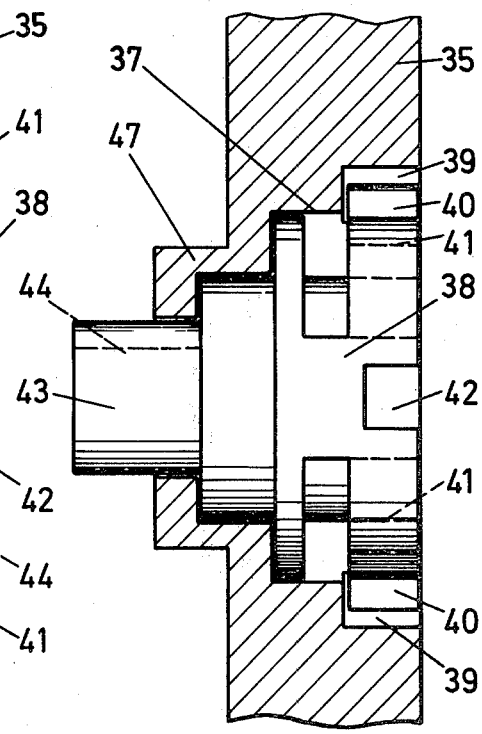

LOCK WITH LOCKING FUNCTION ADAPTED TO BE ACTUATED AFTER THE INSERTION OF A COIN

The present invention relates to a lock having a closing function that is actuatable by introduction of a coin, in which after the insertion of a coin, the coin drops into a supported position in a bolt which is displaceable by key actuation, the edge of the coin releasing the bolt for the locking displacement by disengaging a pawl, the supported position being established by a resting point on the bolt side and a second resting point, the distance between the two resting points being variable as a function of the closing movement.

Such a lock is known from West German Pat. No. 2 017 192, in which a second resting point is developed as a support shoulder fastened to a front wall of the lock. When the bolt is in a forward locked position the coin is moved over this support shoulder. The coin thereby rises and lifts the pawl out of engagement. When the bolt is in its backward locked position the distance between the support shoulder and the bolt-side resting point determines the diameter of the coin. The lock, at the time of its manufacture, must therefore be adjusted to the diameter of the corresponding coin. Subsequent conversion of the lock to a coin of a different diameter is a costly operation.

The object of the present invention is to provide a lock of the above-indicated type which, while of simple design, can be converted to coins of a different diameter in such a manner that conversion can be effected from the outside even without additional individual parts.

This object is achieved by one of the resting points being formed by the free, eccentrically shaped end of a rotary projection which is seated in a bolt-side lever which upon the locking movement passes against spring action into a position which is at a greater distance from the bolt resting point, and that the rotary projection forms an attack surface facing the rear wall of the lock, for engagement with a conversion tool.

As a result of this development, a lock of this type is obtained which is of increased value in use. If the lock, after having been set to a given coin diameter, is to be converted to a coin of a different diameter, the conversion can be very easily effected in a manner wherein the attack surface of the rotary projection which faces the rear wall of the lock is brought into a corresponding angular position by means of a conversion tool. In this way, the distance is changed between an eccentrically shaped end of the rotary projection and the resting point of the bolt. During the forward locking displacement the coin need not be brought into a raised position so that the forward locking motion can be carried out more easily. Nevertheless, during the forward locking displacement the coin comes into a release position since the lever which bears the resting point comes into a position which is at a greater distance from the resting point of the bolt. The eccentrically shaped end of the rotary projection can be formed to allow several angular positions, to enable the lock to be adapted to coins of different diameter. An ordinary tool, such as a screwdriver, can serve as the conversion tool.

In one further advantageous development the attach surface lies behind an opening in the rear wall of the lock. Conversion can thus be effected without taking the lock apart. Conversion of the lock to a coin of a different diameter merely requires removal of the lock from the rear wall of the door.

It has been found advantageous to have the eccentric shape of the end of the rotary projection formed by flats. The number of flats determines the different types of use. Furthermore this structural shape has the advantage of a simple means for supporting the rotary projection.

In order to facilitate location of the different angular positions, the rotary projection is arrested in the different eccentric positions.

Another advantage is that the lever is provided at its end corresponding to the direction of drop of the coin with a second resting point. The second resting point, in the basic position of the lever, is at a distance from a second bolt resting point which corresponds to the diameter of the smallest coin to be received by the lock. The minimum distance between the bolt resting point and eccentrically shaped end is larger than the diameter of the smallest coin. In this way it is possible to convert the same lock from single-coin operation to multi-coin operation. In multi-coin operation is desired, then the distance between the first support point and the eccentric end is made larger than the distance between the second bolt resting point and the second resting point on the lever. The first coin introduced is then not held in a supported position by the first bolt resting point and eccentrically shaped end, but passes into a supported position on the second bolt resting point and the second resting point of the lever. The next coin or coins then rest on the coin which was first introduced. In the final phase of the forward-locking displacement of the bolt the distance between the lever and the bolt-side resting points then increases so that the coins introduced to effect the disengagement of the pawl drop through a coin outlet opening.

A reduction in the structural parts of the lock is furthermore obtained since the lever is controlled by engagement of a control projection with an opening in the rear wall of the lock.

In order that no further coins can be introduced after the forward locking of the bolt, the bolt has a coin barrier extension which obstructs the coin insertion opening upon the forward locking.

It is also advantageous to have two coin emergence openings lying below the bolt associated with the coin drop-out position of the bolt, and to have the drop-out opening which is open, laterally of the coin drop path, towards the front side of the lock brought into action by a bridging plate which can be inserted into the other opening. Accordingly the same lock can be converted both to cash and to deposit operations.

It is furthermore advantageous for the laterally located coin drop-out opening to be adopted to a coin box by means of a removable bottom.

In order, for instance, to be able to release erroneously introduced coins from their holding position on the bolt, a coin return knob which can be actuated from the front wall of the lock is provided to control the lever.

Finally, one other advantageous feature is that the coin return drop path lies above a beveled intermediate wall between the two coin drop-out openings.

One preferred illustrative embodiment of the invention will be explained below with reference to FIGS. 1 to 15, in which:

FIG. 7 is a section along the line VII—VII of FIG. 4;

FIG. 8 is a section along the line VIII—VIII of FIG. 4;

FIG. 9 is in an enlarged view of a portion of the lever in the region of the rotary projection;

FIG. 10 is a vertical section through FIG. 9;

Figure 1:
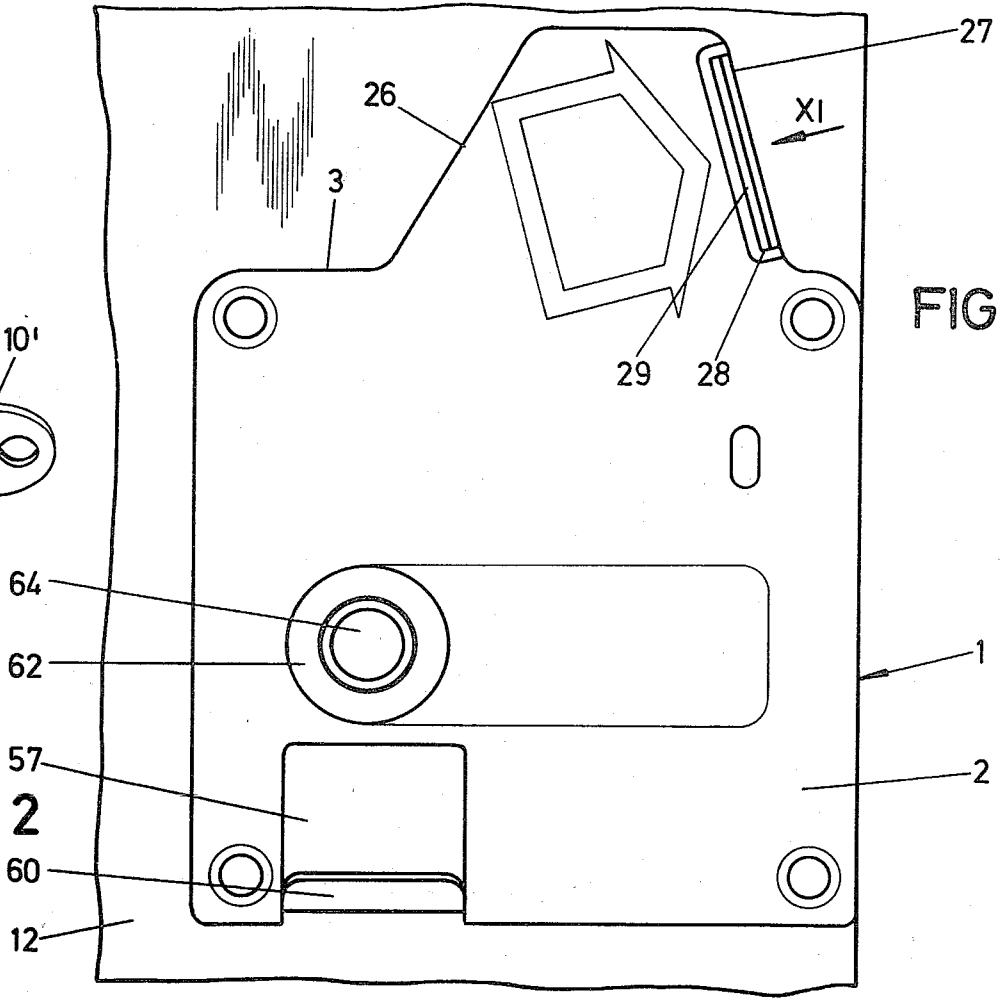
FIG. 1 is a front view of a lock fastened to the rear wall of a door with the bolt in a backward-locked position.
Figure 2:
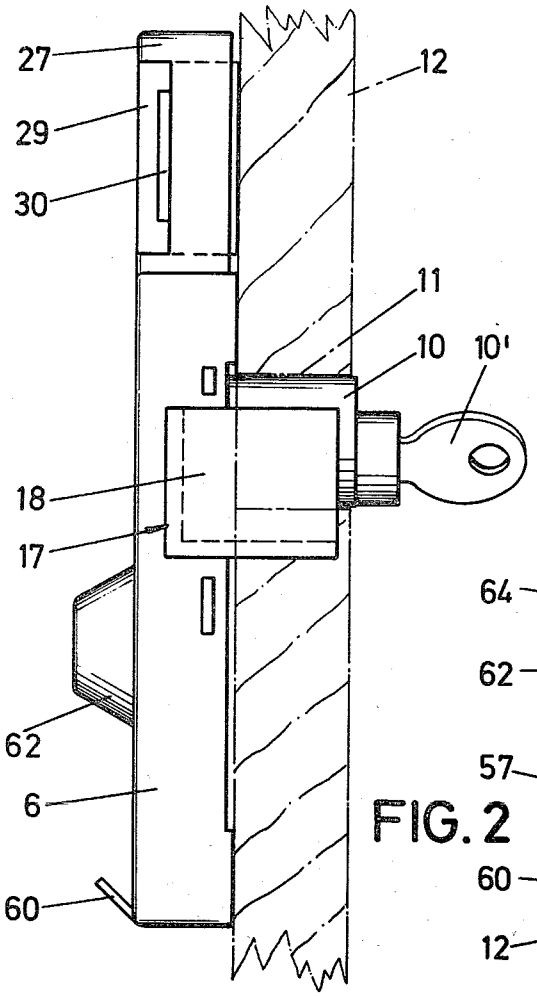
FIG. 2 is a side view thereof with the door shown in dot dash line.

The lock, which is of box-like development, has a lock case 1 which has the lock-case sidewalls 3, 4, 5 and 6 bent at a right angle from the front wall 2 of the lock. The lock ward is covered by a lock rear wall 7 which is held by a screw 9 which enters into a square pin 8 of the lock case.

On the lock cover 7 there is fastened a lock cylinder 10. The lock cylinder 10 passes through a hole 11 of corresponding cross section in a door 12 on the rear of which the lock case rests in known manner and is held by means of screws, not shown.

The lock cylinder 10 contains a cylindrical core 13 the end of which on the inside of the lock case bears a drive lug 14 which is firmly attached to it. From this lug there extends a drive pin 15 which engages in a transverse slot 16 in a bolt 17 guided in the lock case 1. The bolt 17 comprises a bolt head 18, which extends through the lock case sidewall 6, and a bolt tail 19 which defines a slot 20 into which the square pin 8 extends, and serves to guide the bolt 17.

Above the bolt 17 a pawl 22 is pivotally supported on a stud 21 on the lock-case side, which stud is disposed in the corner region between the lock-case sidewalls 3, 6. A leaf spring 23 urges the pawl 22 in a clockwise direction, the locking tooth 24 of the pawl 22 resting in a toothed recess 25 in the bolt 17.

The upper lock case sidewall 3 is formed into a recess 26 which, on its oblique flank 27 facing the lock case sidewall 6, is a shaft 28 for the coin insertion plate 29. The coin insertion plate 29 is provided with two calibrated coin insertion slots 30, 31. As shown in FIGS. 1 to 11, the coin insertion plate 29 is in such a position that the coin insertion slot 30 is free. By pulling the coin insertion plate 29 out and turning it by 180° it can assume the position shown in FIG. 12 so that the undulated coin insertion slot 31 then comes into action.

On the top of the bolt 17 there are two support pins 32 which serve to receive a coin barrier extension 33. When the bolt 17 is in forward-locked position (FIG. 5) a projection 34 of the extension 33 is brought in front of the coin insertion opening 30 or 31. The projection 34 is guided in a slot in a shaft rear wall 77.

Between the lock rear wall 7 and the bolt 17 a lever 35 extends in the rearward region of the bolt 17. This lever 35 is supported on the top of the bolt 17 on a pin 36. In its central region the lever 35 is provided with a bearing hole 37 to receive a rotary projection 38. The bearing hole 37 forms two diametrically opposite detent notches 39 into which diametrically opposite detent projections 40 of the rotary projection 38 extend. Arcuate retraction notches 41 in the rotary projection 38 are associated with the detent projections 40. In the attack surface of the rotary projection 38 which terminates with the front side of the lever 35 there is a slot 42 for a conversion tool (not shown). An end 43 of the rotary projection 38 which is opposite the attack surface (slot 42) protrudes beyond the rear of the lever and is formed into an eccentric by means of a flat 44. The end 43 extends up to the front wall 2 of the lock and represents the first resting point for a coin 45.

Opposite the resting point 43 is a bolt-side resting point 46, the distance between the two resting prints 43 and 46 being smaller than the diameter of the coin 45. A collar 47 (FIG. 8) extends from the lever 35 in the region of the rotary projection 38, the collar passing through an opening 48 in the bolt 17.

The end 35' of the lever 35 which corresponds to the direction of fall of the coin, is provided with a second resting point 49 which in the basic position of the lever 35, (FIG. 4) is at a distance from a second bolt resting point 50.

Figure 3:
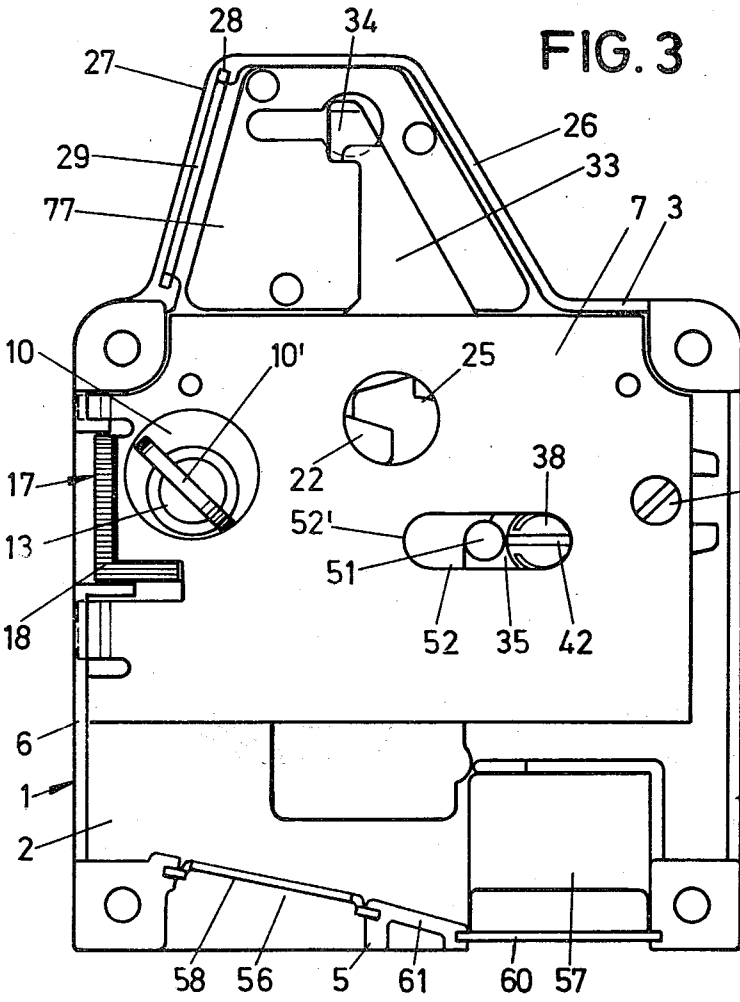
FIG. 3 is a rear view thereof with the bolt in backward locked position.
Figure 6:
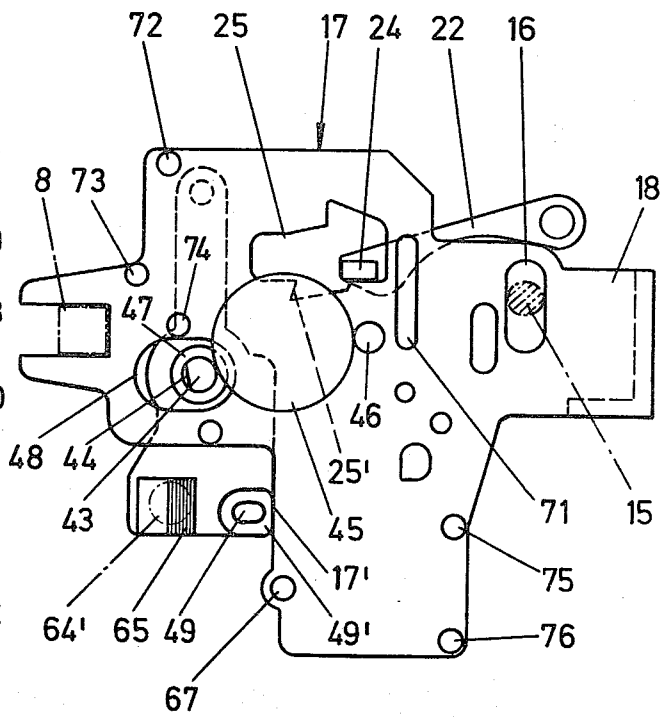
FIG. 6 is a rear view of the bolt in its backward locked position with a coin introduced.
Figure 5:
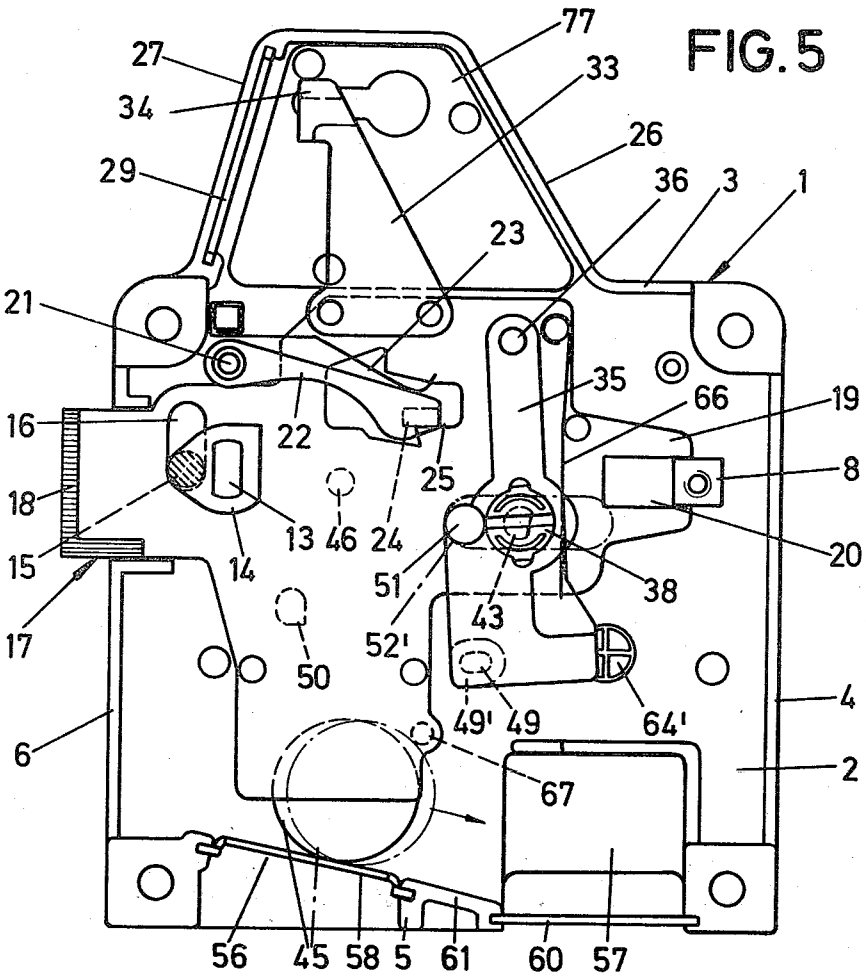
FIG. 5 is a view corresponding to FIG. 4 with the bolt in a forward-locked position.
Figure 11:
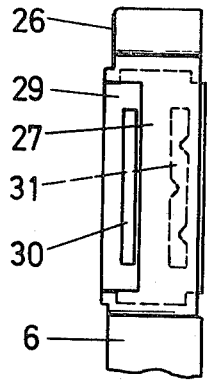
FIG. 11 is a view in the direction of the arrow XI in FIG. 1.

The side of the lever 35 which faces the lock rear wall 7 is provided with a control projection 51 which engages with a slot-like opening 52, located in the lock rear wall 7 in the bolt locking direction. Behind this opening 52 is the attack surface 42 of the rotary projection 38 (FIG. 3).

The bolt 17 is provided with two pins 53, 54, extending up to the front wall 2 of the lock, for locating one end of a leaf spring 55 which acts on the bolt 17, the free end of the spring resting against the stud 21. The spring 55 urges the bolt 17 in a direction into the lock.

Figure 4:
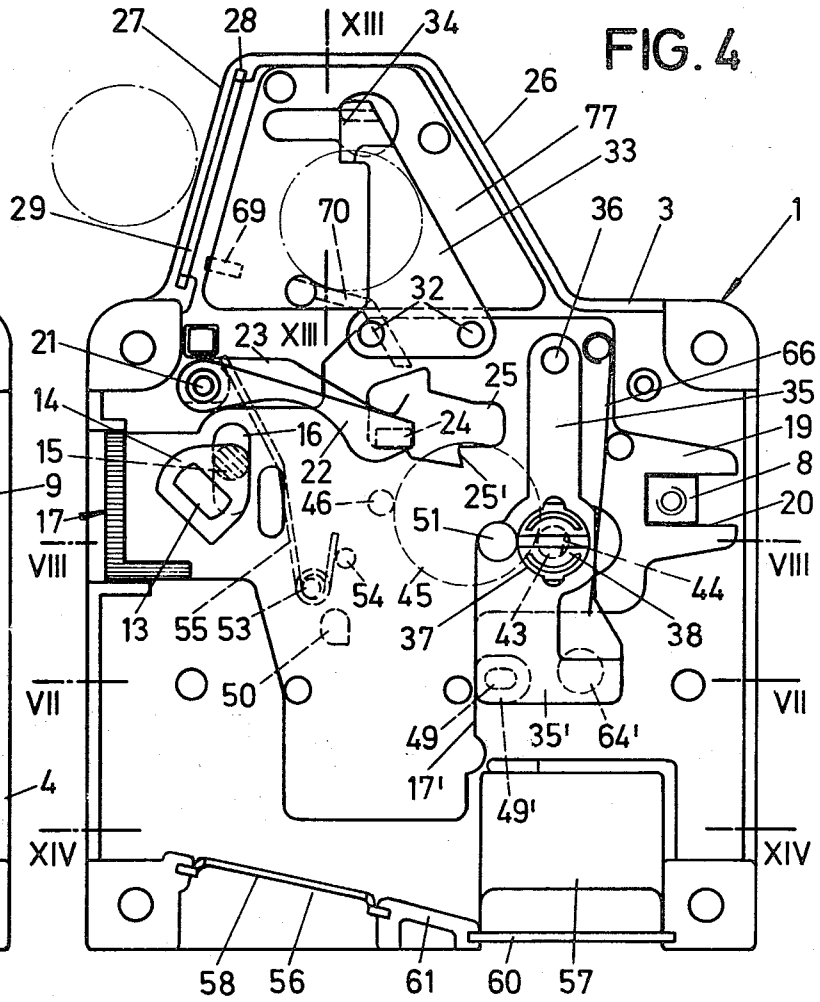
FIG. 4 is a view of the ward of the lock with the rear wall of the lock omitted, also with the bolt in backward-locked position.

Two coin outlet openings 56 and 57 lying below the bolt 17 are associated with the coin drop-out position of the bolt 17. The one drop-out opening 57 which is open laterally of the coin drop path towards the front side of the lock is brought into action by a bridging plate 58 inserted into the opening 56. This bridging plate 58 is of approximately U shape and includes an opening 59 between the U arms. When the bridging plate 58 is in a position such as shown in FIGS. 4 and 7, the coin drop-out opening 56 is bridged over and the downward falling coin 45 is directed into the drop-out opening 57 which is open towards the front side of the lock. The opening 57 is adapted to a coin box by using a removable bottom 60. From FIG. 4 it can be seen that the coin-return drop path lies above an inclined intermediate wall 61 between the two coin drop-out openings 56, 57.

In order to permit the return of the coins, the front wall 2 of the box, within a thickening 62 of the material, bears a coin return button 64 which acts against a compression spring 63. An end 64' of the button 64, which faces the lever 35, is of conical shape and cooperates with an oblique surface 65 on the lever 35 (FIG. 7). When the coin return button 64 is pushed in the direction indicated by the arrow in FIG. 7, the end 64' strikes the oblique surface 65 of the lever 35 causing the lever 35 to be swung such that the distance between the eccentric end 43 of the rotary projection 38 and the bolt resting point 46 becomes greater than the diameter of the coin 45. The coin 45 thus drops through and is conducted to the inclined intermediate wall 61 where it passes to the coin drop-out opening 57 or onto the bottom wall 60 if it is present. The lever 35 always returns into its basic position when urged in clockwise direction by a leaf spring 66. The stop position of the lever 35 is established from an extension 49' having a second resting point 49 abutting a corresponding narrow edge 17' of the bolt 17 (FIGS. 4 and 7).

When the lock is adjusted for single-coin operation, the rotary projection 38 is positioned such that the flat 44 of the end 43 faces away from the first bolt resting point 46. When the proper coin 45 has been inserted, it passes through the positions shown in dashed line in FIG. 4 and comes into a supported position which is established by the resting point 43 and the bolt resting point 46. The forward locking of the bolt 17 by means of the lock cylinder 10 can now begin, the key 10' of which, however, cannot be removed when the bolt 17 is in its rearward locking position. During the forward-locking displacement, the blocking tooth 24 of the pawl 22 is acted on by the coin edge 45. The pawl 22 is thereby raised so that it comes out of the path of movement of the blocking shoulder 25' of the recess 25. The bolt 17 can thus be displaced completely forward. During the final phase of the forward-locking displacement the control projection 51 strikes the edge 52' of the opening 52. As a result of the further displacement of the bolt 17 which then takes place, the distance between the resting point 43 and bolt resting point 46 is increased to permit the coin to drop down and thereby fall onto the bridging plate 58. The coin 45 still can not roll to the coin return box 57 because of a bolt-side support pin 67 as indicated by the dashed line showing in FIG. 5. After a complete forward locking of the bolt 17 the key 10' can be withdrawn. The locker, which for instance, can be provided with this lock is thus locked. Upon opening the lock with the key 10', the bolt 17 is moved back via the lug 14. The coin 45 rolls with movement of the bolt 17 on the bridging plate 58 and the intermediate plate 61. If the distance between the support pin 67 and intermediate wall 61 corresponds to the diameter of the coin, the coin 45 can reach the coin return box.

Figure 14:
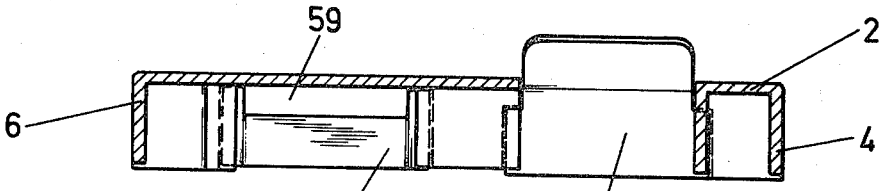
FIG. 14 is a section along the line XIV—XIV of FIG. 4.

If the same lock is to be converted to cash operation, then it is merely necessary to pull out the bridging plate 58 and bring it into the position shown in FIG. 14. Then, during the final phase of the forward locking displacement, the coin 45 drops into the drop-out slot 56 into a cash box, (not shown) located below the slot 56.

Figure 15:
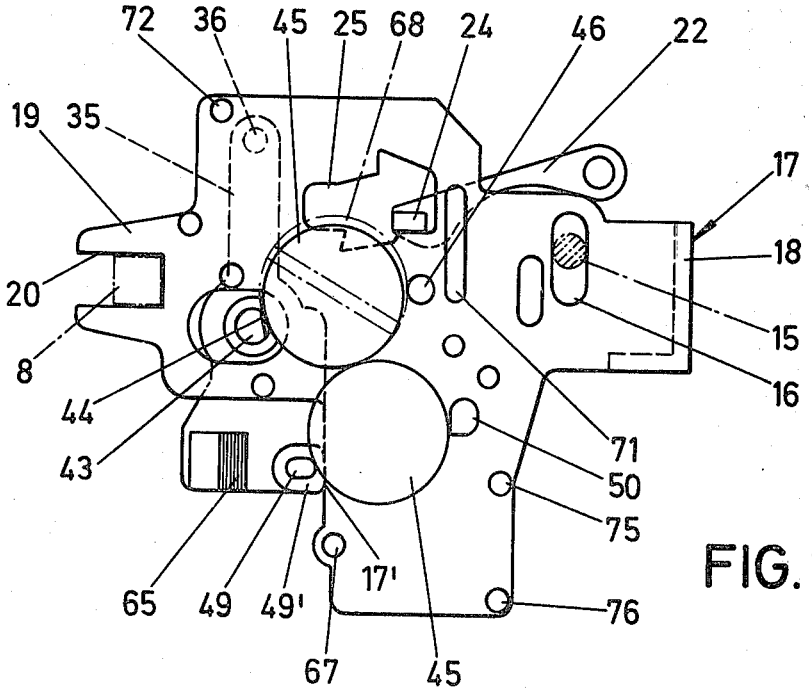
FIG. 15 is a view corresponding to FIG. 6 with the rotary projection brought into a different angular position and with two coins introduced.

If it is desired to convert the lock to multi-coin operation, this can be done by turning the cam 38 by 180°, such that the flat 44 of the end 43 faces the bolt resting point 46 as shown in FIG. 15. The distance between these two points 43, 46 is thus greater than the diameter of the coin 45. This distance is also greater than the distance between the second resting point 49 of the lever 45 and the second bolt resting point 50. The first coin 45 introduced accordingly rests on the second bolt resting point 50 and the second resting point 49. The last coin 45 introduced is supported then on the upper edge of the first coin 45. Accordingly, even though the coin diameter is smaller than the distance between the points 43 and 46, it cannot fall through. During the forward locking displacement the pawl 22 is then shifted in the customary manner by the last coin 45 introduced. With the bolt 17 in its forward-locked position, the lever 35 is then also moved out of its holding position enabling the coins 45 to drop out of their supported position. The intended collection or return of the coins is effected in the same manner.

Figure 12:
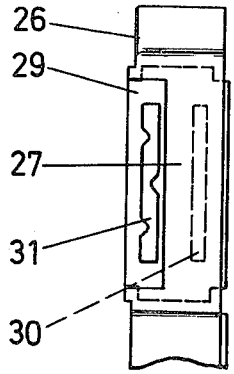
FIG. 12 is a view corresponding to FIG. 11 in which the coin-insertion plate having two calibrated insertion slots is turned 180°.
Figure 13:
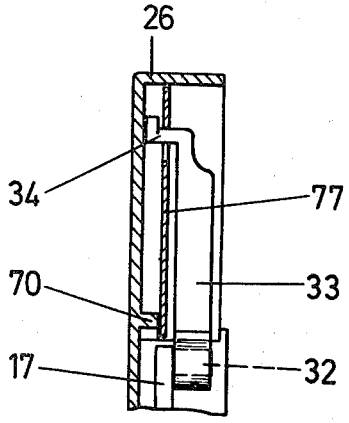
FIG. 13 is a section along the line XIII—XIII of FIG. 4.

If, for instance, a special coin 68 of special cross sectional profile is to be used, the coin insertion plate 29 must be located in the position shown in FIG. 12. The corresponding special coin 68 shown in dashed line in FIG. 15 now rests against the flat 44 of the end 43 of the rotary projection 38 and the bolt resting point 46. The further locking of the lock is effected as previously described.

Instead of the one flat 44 shown in the drawings, the end 43 could have several flats in order to permit the insertion of additional coins of different diameter.

In order for the coins to be directed properly to the corresponding places in the lock, support arms 69, 70 are provided on the front wall 2 of the lock, and support projections 71 to 76 which face the front wall of the lock are furthermore provided on the bolt 17.

We claim:

1. In a lock with a locking function adapted to be actuated after the insertion of a coin, in which the coin drops into a supported position in a bolt which is displaceable by key actuation, the edge of the coin releasing the bolt for locking displacement to a locking position by disengaging a pawl, the supported position being established by a first resting point on the bolt and a second resting point, the distance between the two resting points being variable as a function of the locking displacement of the bolt, the improvement wherein the second resting point is formed by a projection member having an eccentrically shaped end portion, said projection member being seated on a lever pivoted to the bolt, such that upon the locking displacement of the bolt, the lever pivots into a position wherein the distance between the eccentrically shaped end portion and the first bolt resting point is increased, the projection member including an attack surface facing a rear wall of the lock for engagement with a conversion tool.

2. The lock according to claim 1, wherein the lever is restrained by a spring from movement to a position of increased distance between the eccentrically shaped end portion and the first bolt resting point.

3. The lock according to claim 1, wherein the projection member is rotationally supported on the lever member for rotational movement by said conversion tool.

4. The lock according to claim 1, wherein the rear wall has an opening and the attack surface aligns with the opening in the rear wall.

5. The lock according to claim 1, wherein the eccentric shape of the end portion of the projection is formed by flats.

6. The lock according to claim 1, wherein the projection member includes means for arrestment of the eccentrically shaped end portion in different eccentric portions.

7. The lock according to claim 1, wherein the bolt has a third resting point and the lever has an end portion which corresponds to the direction of fall of the coin, said lever end portion having a fourth resting point located a predetermined distance from the third resting point when said lever is in a predetermined basic position, the predetermined distance corresponding to the diameter of the smallest coin to be received by the lock, the smallest distance between the first bolt resting point and the eccentrically shaped end portion being larger than said predetermined distance.

8. The lock according to claim 1, wherein the lock has a coin introduction opening and the bolt has a coin barrier extension member for blocking the coin introduction opening when the bolt has been displaced into the locking position.

9. The lock according to claim 1, wherein the bolt has a coin drop out position, said lock including two coin outlet openings spaced from the bolt, for cooperation with the bolt when said bolt is in said coin drop out position, and a bridging plate for covering one of the outlet openings to permit reception of a coin by the other coin outlet opening.

10. The locking according to claim 1, further comprising a manually actuatable coin return button engageable with the lever to pivot the lever and thereby control lever movement.

11. The lock according to claim 4, wherein the lever has a control projection engageable in the opening in the rear wall of the lock.

12. The lock according to claim 9, wherein the other coin outlet opening is at a front side of the lock laterally of the coin drop path.

13. The lock according to claim 9, wherein the other coin outlet opening has a removable cover for conversion of said other opening to a coin box when said removable cover covers said other opening.

14. The lock according to claim 9, further comprising a beveled intermediate wall disposed between the two coin drop-out openings.

* * * * *